US012151913B1

(12) United States Patent
Martirez, Jr.

(10) Patent No.: US 12,151,913 B1
(45) **Date of Patent: *Nov. 26, 2024**

(54) TAPE ROLL HOLDER

(71) Applicant: Emmanuel Robles Martirez, Jr., St. Louis, MO (US)

(72) Inventor: Emmanuel Robles Martirez, Jr., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/745,808

(22) Filed: Jun. 17, 2024

Related U.S. Application Data

(63) Continuation-in-part of application No. 29/857,278, filed on Oct. 20, 2022, now Pat. No. Des. 1,033,536, which is a continuation-in-part of application No. 16/894,433, filed on Jun. 5, 2020, now Pat. No. 11,498,800.

(60) Provisional application No. 62/858,810, filed on Jun. 7, 2019.

(51) Int. Cl.
*B65H 35/00* (2006.01)

(52) U.S. Cl.
CPC ..... *B65H 35/0073* (2013.01); *B65H 2701/37* (2013.01)

(58) Field of Classification Search
CPC .... B65H 75/20; B65H 35/0026; B65H 75/08; B65H 2301/5151; B65H 2301/515326; B65H 2701/377; B43K 29/20
See application file for complete search history.

(56) References Cited

U.S. PATENT DOCUMENTS

| | | | | |
|---|---|---|---|---|
| 1,818,514 | A | 8/1931 | Whitaker | |
| 2,640,656 | A | 6/1953 | Donkin | |
| 3,134,526 | A | 5/1964 | Schleicher | |
| 3,623,643 | A | 11/1971 | Ikeda | |
| 4,130,229 | A | 12/1978 | Pagnini | |
| 4,884,734 | A | 12/1989 | Kahl, Jr. et al. | |
| 4,919,276 | A | 4/1990 | Kim et al. | |
| D393,002 | S | 3/1998 | Mandar | |
| 10,435,268 | B2 | 10/2019 | Briggs et al. | |
| 11,498,800 | B1 * | 11/2022 | Martirez | B65H 75/08 |
| 2020/0031602 | A1 | 1/2020 | Sarkissian | |

* cited by examiner

*Primary Examiner* — William A. Rivera
(74) *Attorney, Agent, or Firm* — Carmody MacDonald P.C.; Dennis Jm Donahue, III; Kevin C. Staed

(57) ABSTRACT

A tape roll dispenser has a backplate, a spindle, a sidewall, and a cutting surface. The spindle extends outwardly from a section of the backplate that is above a lateral median line, and the tape roll engages with the topside of the spindle. The sidewall is attached to the spindle's distal end and/or the backplate and extends to an upper end that is further away from the lateral median line than the spindle's topside, and no structure extends over the spindle's topside from either the sidewall or the backplate. The cutting surface extends outwardly from the backplate at a location below the spindle's topside. A writing device holder is connected to and extends outwardly from the backplate, sidewall, or cutting surface. A tab can extend upwardly from a center section of the cutting surface to prevent the bottom section of the tape roll from swinging out away from the backplate.

20 Claims, 4 Drawing Sheets

TAPE ROLL HOLDER

CROSS-REFERENCE TO RELATED APPLICATIONS

This application is a continuation-in-part of U.S. patent application Ser. No. 29/857,278 filed on Oct. 20, 2022 which is a continuation-in-part of U.S. patent application Ser. No. 16/894,433 filed on Jun. 5, 2020 and which claims priority from U.S. Provisional Patent Application No. 62/858,810 filed on Jun. 7, 2019, each of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to tape holders in which segments of adhesive tape can be dispensed from rolls of adhesive tape and relates more particularly to tape holders that are mounted to a vertical surface.

Related Art

Adhesive tape is an extremely versatile tool used in nearly every home, office, and industry. It is manufactured and sold in rolls made from a wide array of materials, a large variety of adhesives, and comes in a vast selection of formats for purposes ranging from general household use to highly specialized, industry-specific functions. Without a dispenser, rolls of adhesive tape can be difficult to use. The end of the tape spooled upon the roll adheres to the rest of the tape roll and it is often difficult for a user to locate the end of the tape and separate it from the rest of the roll for use. Once the end of the tape is located and separated, it is then often difficult for users to cut lengths of tape from the roll without the aid of scissors as tearing the tape by hand can be sloppy, imprecise, and difficult depending on the characteristics of the material of which the tape is made. In order to make the storage and cutting of lengths of tape from rolls of tape more convenient, a number of holders and dispensers have been developed over the years.

Tape dispensers designed to be kept on a table or countertop can be bulky and unsightly, add to clutter, and reduce the useable surface area. Other adhesive tape storage and dispensing devices are typically stored in a drawer and often become buried and entangled with other items making them difficult and inconvenient to find and extract. Since many current adhesive tape storage and dispensing devices merely sit on a surface and are freely movable, they are also frequently moved and then misplaced during their use which makes the tape unavailable for subsequent uses or other users who may expect the tape dispenser to be placed back in a designated storage location.

In an attempt to solve some of the known problems with misplacing tape dispensers that can be readily moved to different locations, U.S. Pat. No. 4,130,229 which is incorporated by reference herein discloses a tape dispenser particularly suited for dispensing tape when mounted on a substantially vertical surface. However, the '229 Patent follows the example of most previously known and current tape holders and dispensers which have a full circle spindle which holds the tape core and that require opening or partially disassembling parts of the dispenser in order to remove, replace and secure rolls of tape on the spindle. This process is accomplished with varying degrees of effort and difficulty depending on the complexity of the storage device. For example, the '229 Patent discloses a tape roll retaining cap which has a roll restraining head portion that must be separated from a plug portion in order to replace a roll of tape, and the roll restraining head portion must then be fit back into the plug portion to secure the roll of tape. A similar design is shown in U.S. Pat. No. 4,884,734 which is also incorporated by reference herein.

In other designs, such as shown in U.S. Des. Pat. 393,002 which is incorporated by reference herein, the dispenser can be opened by rotating a hinged cover away from the roll of tape to reveal the spindle and then rotated back to close over the roll of tape and hold it in place on the spindle. In other dispensers, such as disclosed in U.S. Pat. No. 4,919,276 which is incorporated by reference herein, the spindle has a shaft that is engaged and held in place by a pair of slots within a recess for the roll of tape, and the spindle must be removed from the slots to replace the roll of tape. In the '734 Patent, as well as many other tape dispensers in which the spindle can rotate relative to the cutting edge of the dispenser, the spindle is designed to have a peripheral surface which engages the core of the roll of tape with a friction fit so that the spindle rotates with the roll as segments of tape are pulled from the roll, and when the tape is spent, the spindle must be removed from the base of the dispenser so that it can be separated from the core and a new roll can be placed onto the spindle. In many instances, it would be preferable to be able to place the roll of tape onto the spindle without opening or disassembling parts of the dispenser.

One way to avoid opening or disassembling parts of the dispenser is to use a spindle that includes a flexible tab with a lip projecting outwardly at the distal end of the tab, such as disclosed in U.S. Pat. Nos. 10,435,268 and 2,640,656 which are incorporated by reference herein. The lip depresses inwardly to let the core of the tape pass over it and slide onto the spindle for usage without having to open or disassemble any part of the dispenser. Although the spindle with the flexible tab and lip results in an improved tape dispenser compared to the dispensers that require some disassembly or opening, the spindle still needs to be manipulated by a user to replace one roll of tape with another roll of tape, and there could be times when a user wants to use a roll of tape apart from a tape dispenser, and in such a case, it would be preferable if the user could more easily remove the tape from the dispenser without having to separately manipulate parts on the spindle.

In many prior art tape roll holders, there is structure that extends over the topside of the spindle which prevents the tape roll from fully disengaging from the spindle. In U.S. Pat. No. 3,623,643, the structure above the spindle includes the cutting edge as well as a guide since the spindle is actually springlike and moves relative to the mounting structure and base to bias the tape roll towards the cutting assembly which is attached to the mounting structure. In US Pat. App. Pub. No. 2020/0031602, the entire roll of tape is enclosed within the housing and the cap. These holders are designed for the portability with the tape roll held in place so it remains in place on the spindle. When considering a holder that remains fixed in a particular location, there is no longer any need to have any structure extending over the spindle's topside to block the tape roll from disengaging from the spindle because gravity performs this function, such as with fixed hooks from which items are suspended.

As evident from the '276 Patent and the '002 Design Patent, some tape dispensers have been known to be combined with a pen holder and may also include a stamp dispenser, a tray for a memo pad, and/or a note pad. In the prior art, the pen holder is spaced a sufficient distance from the tape dispenser such that any pen in the pen holder would not need to be moved when a roll of tape is being replaced in the tape dispenser. For economy in the use of material to make the tape dispenser as well as efficiency in the use of space by the tape dispenser, it would be advantageous in some installations of a tape dispenser for the pen holder to be formed as a part of a feature in the tape dispenser.

Accordingly, there remains a desire for a tape dispenser in which a roll of tape can be replaced without opening or disassembling parts of the dispenser or any manipulation of the spindle. It would also be beneficial for the tape dispenser to allow a user to separate a roll of tape from the dispenser for use away from the dispenser by just grasping the tape and without having to open, disassemble, or otherwise manipulate any part of the tape dispenser. There may be additional benefits for the economic use of material in the manufacture of the tape dispenser and for the efficient use of space in the installation of the tape dispenser, particularly including an integral writing device holder for a marker, pen, or other writing implement.

SUMMARY OF THE INVENTION

The invention is a dispenser for a roll of tape. In one aspect of the invention, the spindle that holds the roll of tape extends outwardly from the upper section of the backplate and has a topside that faces away from the backplate's lateral median line. A sidewall that is parallel to the backplate's plane is fixedly attached to the distal end of the spindle and/or the backplate, and the upper end of the sidewall is further from the lateral median line than the topside of the spindle. The cutting surface extends outwardly from the backplate and is located below the spindle's topside.

In another aspect of the invention, a writing device holder connects to the tape dispenser.

In yet another aspect of the invention, the cutting surface's serrated edges have a longer tooth positioned between two sets of teeth.

Additionally, a further aspect of the invention is a tab that extends upwardly from a center section of the cutting surface between serrated edges at opposite sides.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 3:
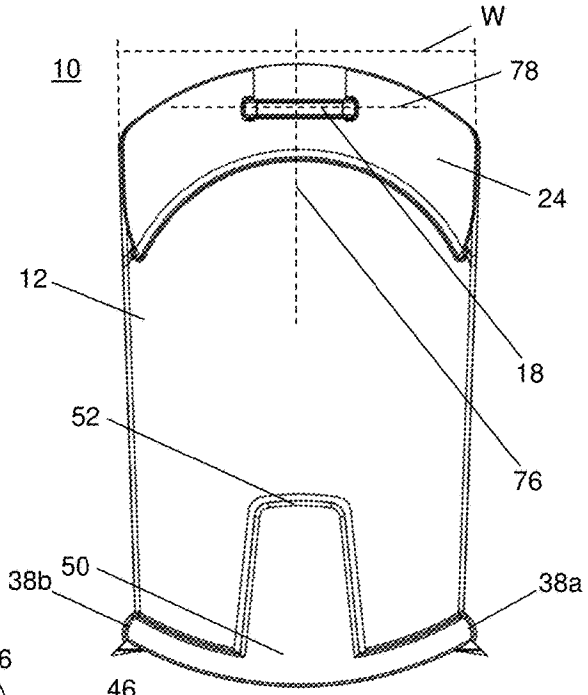
FIG. 3 is a front view of the tape roll dispenser shown in FIG. 1.
Figure 2:
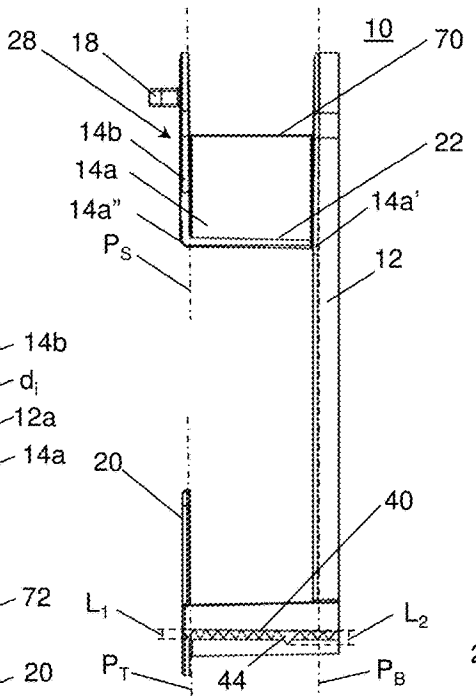
FIG. 2 is a side view of the tape roll dispenser shown in FIG. 1.
Figure 4:
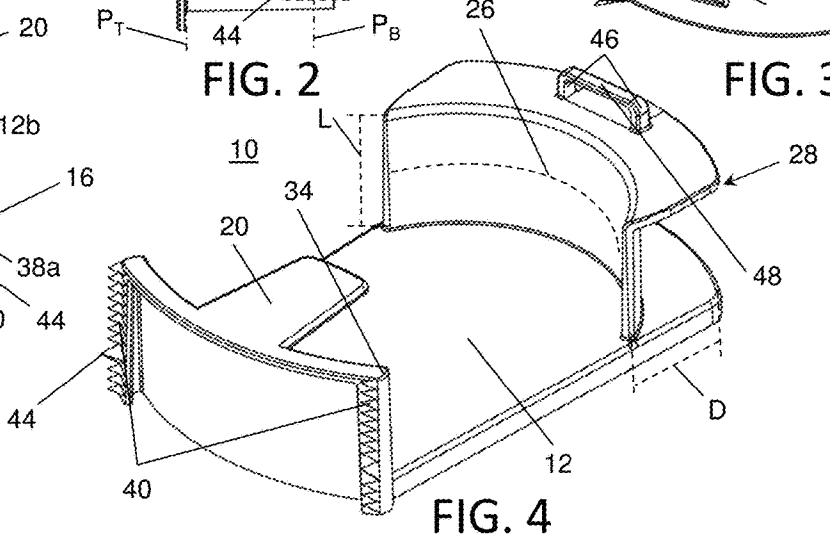
FIG. 4 is a bottom perspective view of the tape roll dispenser shown in FIG. 1.
Figure 1:
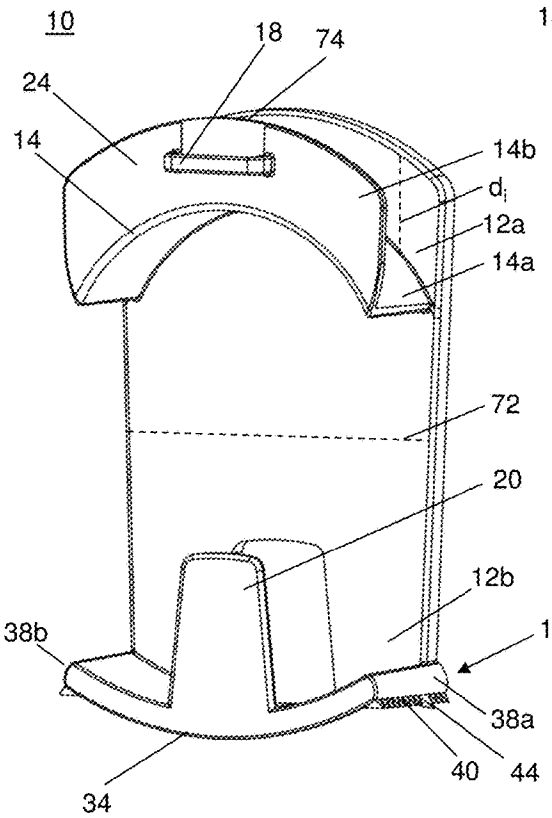
FIG. 1 is a front perspective view of a tape roll dispenser of a first embodiment according to the present invention.

The following description of the preferred embodiment(s) is merely exemplary in nature and is in no way intended to limit the invention, its application, or uses.

The tape roll holder of the present invention serves as a tape roll dispenser 10 for segments of tape from a roll of adhesive tape 100 and also provides a place to hold a writing device 110, such as a marking pen, that can be used to mark tape segments. Generally, as shown in FIGS. 1-12, the tape roll dispenser has a backplate 12, a spindle 22, a cutting surface 16, a tab 20, and a writing device holder 18. It will be appreciated that the tab and writing device holder are optional features of the tape roll dispenser. As explained in more detail below, the tab extends upwardly from a location proximate to the lower section of the backplate 12*b* and is preferable for the embodiments shown in the drawings in which the spindle serves as a hook 28 formed by an arcuate channel 14 with a bottom trough 14*a* and an integral sidewall 14*b* proximate to the upper section of the backplate 12*a*, and the roll of tape hangs from the hook by gravity. Generally, the roll engages the spindle's topside 70. In operation, a person pulls on the end of the tape and the roll of tape rotates on the spindle relative to the backplate around an axis of rotation 36, and the tab helps prevent the roll of tape's lower side from swinging away from the backplate while the tape is rotating and also while the segment of tape is being cut from the roll on the serrated edge 40 as described below.

The tape roll dispenser 10 can be attached to a vertical surface, such as a wall or door, using any type of fastener. Without limitation, examples of fasteners that can be used to mount the tape roll dispenser to a vertical surface include double sided tape, magnets, screws, epoxy or glue, and hook and loop fasteners. When mounting the dispenser using screws, it is preferable to provide screw holes 58 in the backplate, such as shown in FIGS. 8-12.

The upper section and the lower section of the backplate are preferably arranged within an outer perimeter 60 in a single plane ($P_B$) which so that the backplate's entire backside surface can be mounted flush to a vertical surface. The backplate's upper section and lower section are on opposite sides of a lateral median line 72, and for the spindle to function as a hook, its topside 70 faces away from the lateral median line, and no structure extends over spindle's topside. In particular, since gravity holds the tape roll in engagement with the spindle's topside and the tape roll dispenser is designed to remain in a fixed orientation relative to the vertical surface to which it is mounted, neither the sidewall nor the backplate have any structure that extends over the spindle's topside.

The bottom trough of the arcuate channel is attached to the upper section of the backplate at its proximal end 14*a*' and extends substantially perpendicular to the backplate by a length (L) that is preferably shorter than the lateral width (W) of the spindle, particularly its bottom trough. The sidewall is located at the distal end of the bottom trough 14*a*" and is arranged in a plane ($P_S$) that is substantially parallel to the plane of the backplate (i.e., $P_S \| P_B$). Accordingly, in functioning like a hook, the spindle has a width that is greater than the length. In particular, the arcuate channel has an arc length 26 that is less than a semicircle, preferably greater than 60° and less than 120°. Preferably, the depth (D) of the bottom trough between the sidewall and the backplate is less than the length of the bottom trough. The sidewall's upper end 74 can be approximately aligned with the top of the backplate as in the first embodiment or it may be situated below the top of the backplate, such as in the embodiments shown in FIGS. 8 and 11, or it could be situated above the top of the backplate, such as in the embodiments shown in FIGS. 9 and 10. When the sidewall's upper end is above the backplate's top, the channel is between the sidewall and vertical surface to which the backplate is mounted. Regardless of the height of the sidewall's upper end relative to the backplate's top, the upper end is located further from the lateral median line than the spindle's topside which produces the channel which holds the tape roll like a hook.

Figure 10:
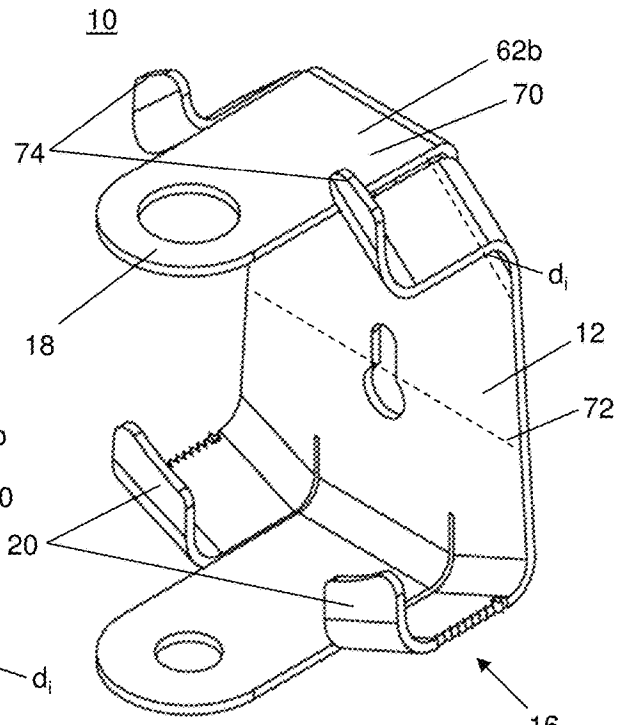
FIG. 10 illustrates a third alternative embodiment of the tape roll dispenser according to the present invention.
Figure 9:
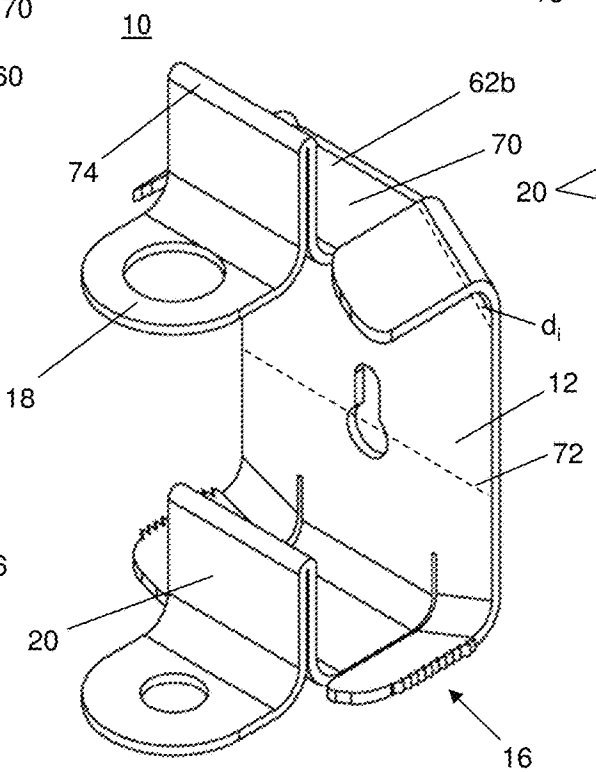
FIG. 9 illustrates a second alternative embodiment of the tape roll dispenser according to the present invention.
Figure 8:
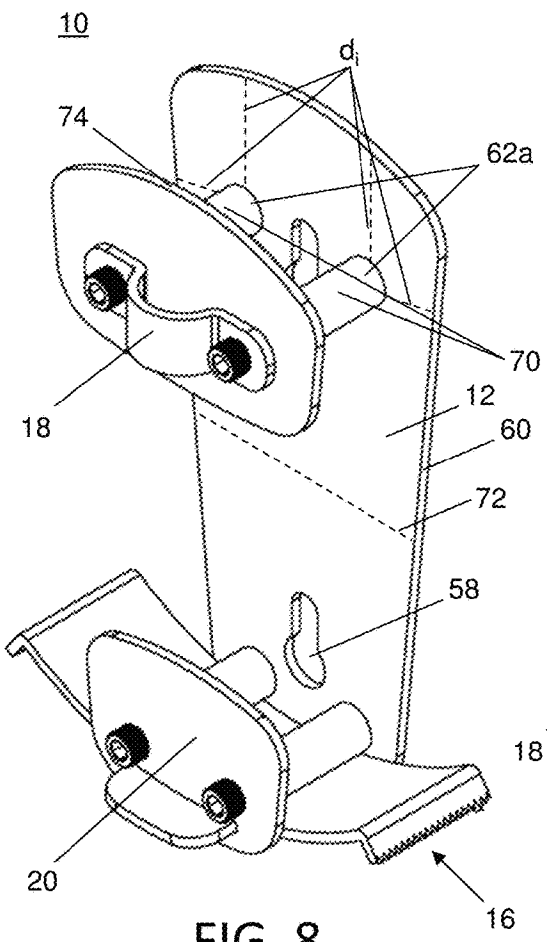
FIG. 8 illustrates a first alternative embodiment of the tape roll dispenser according to the present invention.
Figure 11:
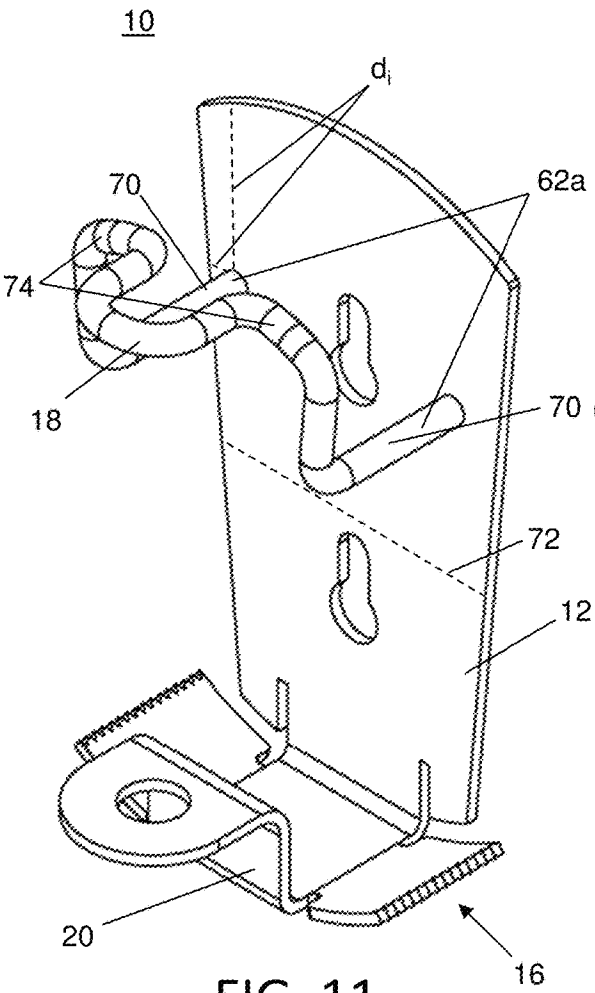
FIG. 11 illustrates a fourth alternative embodiment of the tape roll dispenser according to the present invention.

Spindle designs that are known in the prior art can be used in the present invention, and alternative spindle designs are illustrated in FIGS. 8-11. In FIG. 8, the spindle is formed by a pair of posts 62*a* that are preferably fastened to the backplate by a pair of screws. As shown in FIGS. 9 and 10, the spindle could be formed by a beam 62*b* (or a spar). In these embodiments, the beam, the backplate, and the tab are all formed from a single thin-wall sheet of material (preferably metal or structural plastic) and the beam and tab are bent into their orientations relative to the backplate. The pair of posts shown in FIG. 11 are formed as a continuous wire that also forms the sidewall as well as the writing device holder. Generally, in each one of the embodiments, at least a portion of the spindle is spaced a distance inward (di) from the backplate's outer perimeter.

The cutting surface extends substantially perpendicular to the lower section of the backplate to a distal edge of the cutting surface 34. The length of the cutting surface from the backplate is approximately equal to the length of the bottom trough. Preferably, the cutting surface extends from the bottom edge of the backplate and has a pair of sides 38*a*, 38*b* that are beneath the opposite sides of the arcuate channel so that its width is similar in size to the width of the bottom trough. Although the cutting surface does not need to be at the backplate's bottom edge, it is located below the spindle's topside and is preferably connected to the lower section of the backplate, i.e., below the lateral median line. Accordingly, the topside of the spindle is located between the sidewall's upper end and the cutting surface, preferably in fixed location relative to the backplate. At least one of the cutting surface's sides has a serrated edge 40 and preferably both sides have a serrated edge which are substantially parallel to the axis of rotation. The serrated edge further has two sets of teeth with a first length ($L_1$) and a tooth 44 positioned between the sets of teeth 42*a*, 42*b* which has a second length ($L_2$) that is greater than the first length ($L_2 > L_1$). The longer tooth 44 helps to initiate the cut in the tape and is preferably offset to be closer towards the backplate so that when a person pulls a segment of tape to be torn from the roll, the shorter width of the tape that tears is closer to the backplate and wall on which the dispenser is mounted while the longer width of the tape that tears is closer to the person who is pulling the tape. The sides of the cutting surface also preferably include a landing space above the serrated edge which allows a portion of the adhesive tape to stick while the segment of tape is being separated from the roll.

The tab has a base 50 that is preferably attached to the distal edge of the cutting surface and extends upwardly to a tip 52. The tab is arranged in a plane ($P_T$) that is substantially parallel to the backplate's plane (i.e., $P_T \| P_B$) and positioned at a center section of the cutting surface between the sides with the serrated edges. The tab's plane ($P_T$) is preferably aligned in the same plane as the sidewall's plane ($P_S$). Since there is no sidewall in the lower section of the backplate, the tab prevents the roll of tape from swinging outwards while it is rotating on the spindle. Just as there could be different designs for the spindle, there could also be different designs for the tab. Although not shown in the drawings, it will be appreciated that the base of the tab could be connected directly to the backplate with a bend between the base and the tip.

Figure 7:
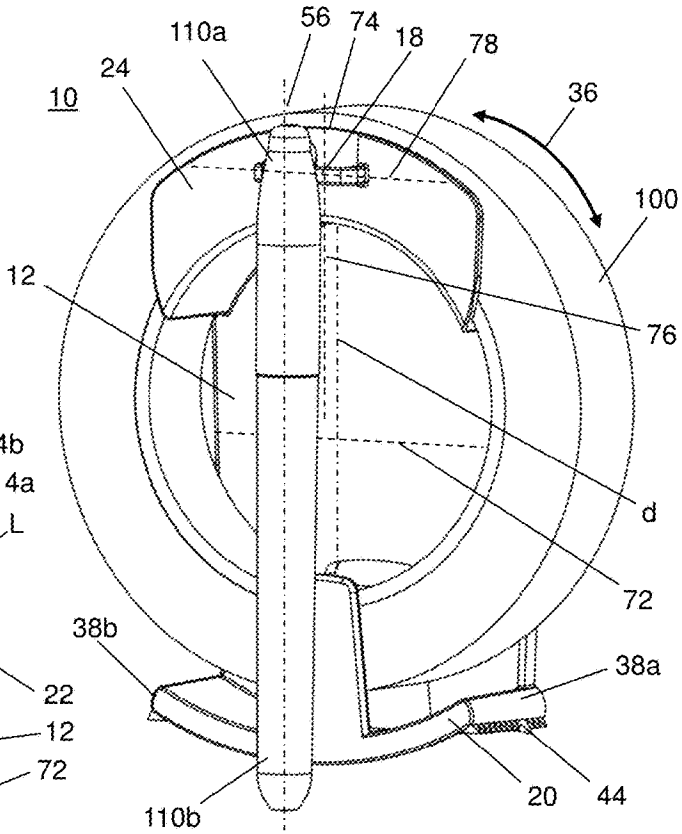
FIG. 7 is a front perspective view of the tape roll dispenser shown in FIG. 1 with a roll of tape and a writing device held thereon.
Figure 6:
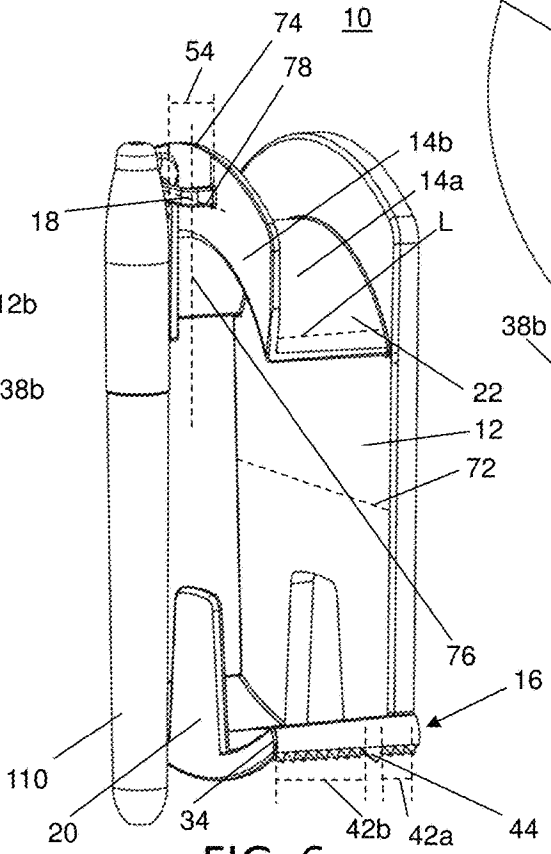
FIG. 6 is a side perspective view of the tape roll dispenser shown in FIG. 1 with a writing device held thereon.
Figure 5:
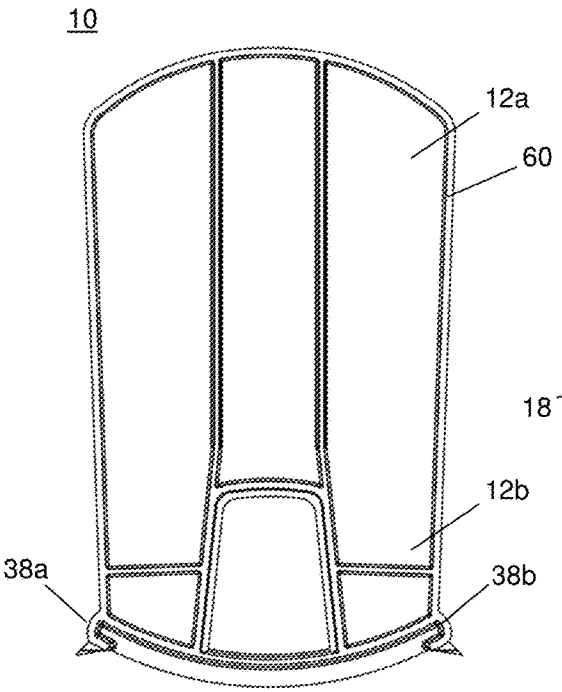
FIG. 5 is a back view of the tape roll dispenser shown in FIG. 1.

The writing device holder is preferably attached to an external face of the sidewall 24 of the arcuate channel with a longitudinal axis 56 that is parallel to the backplate's plane. In the embodiment shown in the drawings, the writing device holder has a pair of posts 46 extending substantially perpendicular to the external face and a bar 48 connected between the posts. As shown in FIGS. 6 and 7, the sidewall separates the roll of tape from a proximal end 110*a* of the writing device 110 that is engaged with the bar, and a distal end of the writing device 110*b* extends to a location proximate to the distal edge of the cutting surface approximately equidistant between the pair of sides of the cutting surface. Variations of the post and bar writing device holder are shown in FIGS. 8-11.

Figure 12C:
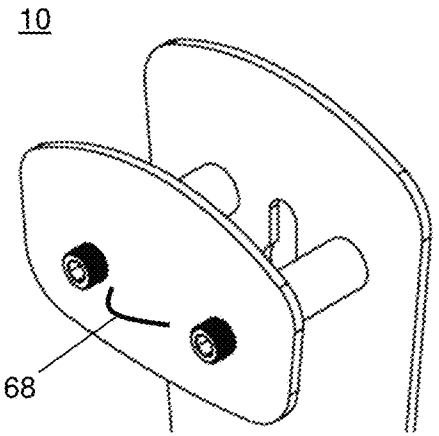
FIGS. 12A-12D illustrate alternative writing device holders for use with the tape roll dispenser according to the present invention.
Figure 12D:
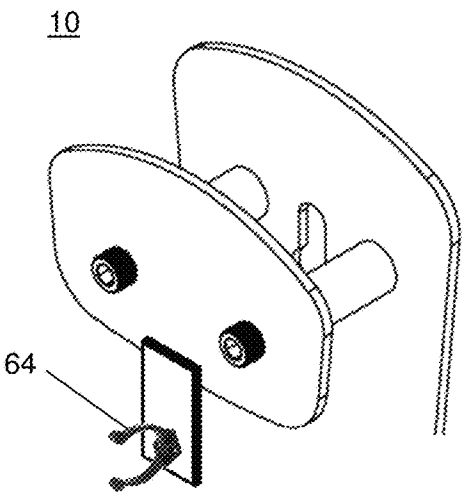
Figure 12A:
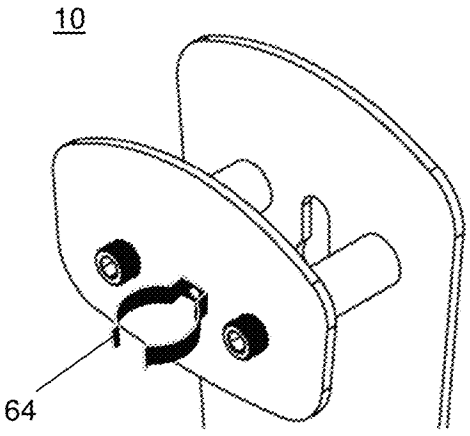
Figure 12B:
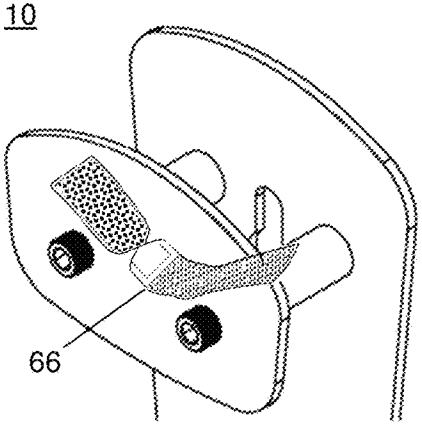

It will be appreciated that the writing device holder can be attached to the tape roll dispenser 10 anywhere that is spaced a sufficient distance 54 away from the roll of tape to avoid an interference between the roll and the writing device. For example, the writing device holder can be connected to the side of the backplate in a manner similar to the design shown in the '002 Design Patent. It will also be appreciated that the writing device holder could be attached to the top or bottom of the backplate or to the spindle or the cutting surface. For example, the writing device holder may be a friction fit aperture similar to the pen holder in the '276 Patent which is attached to the top of the tab or below the cutting surface or below the arcuate channel. Other writing device holders might be other type of friction fit connections or clips or may even use hook and loop fasteners. Some of these different types of writing devices holders are shown in FIGS. 12A-12D as they could be fastened to the sidewall's external face, such as a clip 64 in FIG. 12A, a hook and loop fastener in FIG. 12B, and an elastic strap in FIG. 12C. In FIG. 12D, the clip is connected to a sidewall extension that reaches down to the lateral median line. Also, as shown in FIGS. 9 and 11, the writing device holder can be connected to the sidewall as an integral part of the sidewall, or as shown in FIG. 10, the writing device holder may be integrally formed as a part of the spindle.

As described above, the writing device holder can be connected to the tape roll dispenser at various locations. As particularly shown in FIG. 3, a preferred location for the writing device holder is at the front of the tape roll dispenser, adjacent to the sidewall's plane ($P_S$), so that the writing device is easily reached without any interference by the tape roll which is on the spindle. The preferred lateral location for the writing device holder is a centerline 76 with respect to the spindle's lateral width (W). The preferred longitudinal location for the writing device holder is an elevation line 78 above the backplate's lateral median line 72, preferably at or above the spindle's topside 70, but as shown in FIG. 12D, the longitudinal location can be positioned closer to the lateral median line or may even be connected to the tab or an extension to the backplate at the bottom of the tape roll dispenser (not shown). These preferred locations result in an efficient use of space for the tape roll dispenser when it is in use, holding the writing device so that its length is substantially aligned with a diameter (d) of the roll of tape.

As shown in FIGS. 6 and 7, when the writing device holder is positioned near the spindle's topside, the top of the writing device extends upwards and may extend beyond the sidewall's upper end 74 while the bottom of the writing device extends downwards towards the bottom of the backplate and/or the cutting surface. As particularly shown in FIG. 7, since the tape roll is also centered relative to the spindle's lateral width, the longitudinal axis of the writing device is aligned with the tape roll's vertical diameter as it hangs from the writing device holder. Similarly, for a writing device holder in which the elevation line is positioned at the bottom of the tape roll dispenser, the writing device could be held up so the longitudinal axis of the writing device is aligned with the tape roll's vertical diameter. If the location of the writing device holder is positioned at a centerline and elevation line which generally coincide with the axis of rotation for the roll of tape, the writing device could be held in a plane adjacent to the sidewall plane and/or the tab plan at any angle relative to the median line, i.e., vertical, horizontal, or diagonal, and the longitudinal axis of the writing device would aligned with the corresponding diameter of the tape roll. For example, a writing device that is placed in the clip shown in FIG. 12D would be held laterally across the tape roll dispenser so the longitudinal axis of the writing device would be aligned with the tape roll's horizontal diameter.

The roll of tape's hanging position depicted in FIG. 7 is achieved by positioning the open core of the roll around the arcuate channel while the bottom portion of the tape roll is positioned above the tab. The core is then lowered into the arcuate channel while the bottom portion of the tape roll is situated between the tab and the lower section of the backplate, allowing the roll to hang from the arcuate channel while the tab prevents the roll of tape from swinging outwardly from the backplate. Accordingly, a user can replace rolls of tape on the tape dispenser of the present invention without any disassembly or opening actions so that the user can remove and place rolls of tape on the dispenser with a single hand and without having to separately manipulate parts on the spindle. After the roll is placed in the channel, the writing device can then be hung from the writing device holder by placing the writing device's clip structure over the bar which is preferably an integral structure of the dispenser. It will be appreciated that the length that the arcuate channel extends from the upper section of the backplate and the corresponding distance of the tab from the lower section of the backplate can be optimized to fit particular sizes of tape. For example, some painting tape is only around one inch (1") in width which is approximately half the standard width of masking tape, duct tape, and packing tape. The illustrations show a channel that would fit the thinner width painting tape, and it will be appreciated that a longer extension of the bottom trough from the backplate would accommodate the wider type of tape.

The advantages of the present invention include, without limitation, the maximum space savings and minimum visual distraction it provides over current adhesive tape storage and dispensing devices made possible by its ability to store a roll of tape up and out of the way parallel to a vertical surface such as a wall, cabinet, or refrigerator door as opposed to on a table, countertop, or in a drawer. In addition, as the device is designed to function as a fixture to remain stationed in a single location on a semi-permanent to permanent basis, the present invention provides a constant and reliable location users can always expect to find and access a roll of tape unlike current adhesive tape storage and dispensing devices which are often moved and misplaced during use. Additionally, the open design of the present invention's arcing channel on which rolls of tape are meant to simply hang upon as a hook rather than be secured by more complicated apparatus allows for rolls to be quickly and easily removed and replaced and makes the process of removing and replacing rolls much faster and more simple than current tape holders and dispensers that require opening or partial disassembly of the device to access and place rolls of tape within. Also, by integrating a means to hang a marking pen along with a roll of tape, the preferred embodiment of the present invention provides a functionality not found on any previous adhesive tape roll storage and dispensing devices making it easy to use tape in conjunction with a marking pen as a convenient labeling solution. It will also be recognized that the tape roll dispenser 10 of the present invention can be produced as an integral, molded device with no moving parts so it may be produced more affordably than other, more complicated tape storage and dispensing devices and may present a lower-cost option for consumers.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the preferred embodiment shows a spindle with an integral sidewall, it will be appreciated that the aspects of the present invention, such as the writing device holder, could be incorporated into previously known tape dispensers that are vertically mounted, such as the '229 Patent and the '734 Patent. As another example, although not preferred, the present invention could have spindles as disclosed in these previously known tape dispensers which require a separate structure, such as a cap or head structure or a sleeve, that connects to the spindle; according to the preferred embodiment of the present invention, the spindle is formed by the bottom trough with the integral sidewall and acts like a hook so there is no need for a separate structure. The '276 Patent discloses a separate spindle that could be incorporated into the present invention; in particular, the spindle could be held in a slot in the backplate, and there could also be a slot in the sidewall. Of course, in comparison to the '276 Patent, in the present invention, the sides of the tape roll are exposed so the tape can extend to the cutting surface below the tape roll. Thus, the breadth and scope of the present invention should not be limited by any of the above-described exemplary embodiments, but should be defined only in accordance with the following claims appended hereto and their equivalents.

What is claimed is:

1. A dispenser for a roll of adhesive tape, comprising:

a backplate extending from a first section to a second section within an outer perimeter, wherein the first section is on an upper side of a lateral median line and the second section is on a lower side of the lateral median line;

a spindle connected to the first section of the backplate at a proximal end and extending substantially perpendicular to the first plane to a distal end, wherein the spindle is spaced inward from the outer perimeter, wherein a topside of the spindle faces away from the lateral median line, and wherein the roll of adhesive tape engages the topside of the spindle and rotates on the spindle relative to the backplate around an axis of rotation perpendicular to the first plane;

a sidewall fixedly attached to at least one of the distal end of the spindle and the backplate, wherein the sidewall extends substantially perpendicular to the spindle to an upper end and is situated within a second plane substantially parallel to the first plane, wherein the upper end of the sidewall is further from the lateral median line than the topside of the spindle; and a cutting surface connected to and extending substantially perpendicular to the backplate to a distal edge of the cutting surface, wherein the cutting surface is located below the topside of the spindle such that the topside of the spindle is located between the upper end of the sidewall and the cutting surface, wherein the cutting surface comprises a pair of sides, and wherein at least one of the sides comprises a serrated edge.

2. The dispenser of claim 1, further comprising a writing device holder connected to at least one of the backplate, the sidewall, and the cutting surface.

3. The dispenser of claim 2, wherein the writing device holder is selected from a group of holders consisting of a bar, a clip, an aperture, hook and loop fasteners, and any combination thereof, and wherein the writing device holder is positioned along a centerline relative to a width of the spindle.

4. The dispenser of claim 3, wherein the spindle is selected from the group of support structures consisting of an arcuate surface, a beam, a plurality of posts, and any combination thereof, wherein the spindle is fixedly located relative to the first section of the backplate, and wherein the writing device holder is positioned at an elevation line that is at or above the lateral median line.

5. The dispenser of claim 1, wherein the cutting surface is connected to the second section of the backplate on the lower side of the lateral median line, and wherein the serrated edge is substantially parallel to the axis of rotation.

6. The dispenser of claim 1, further comprising a writing device holder connected to the sidewall, wherein the writing device holder is positioned along a centerline relative to a width of the spindle.

7. The dispenser of claim 1, wherein each one of the sides of the cutting surface comprises a serrated edge, and wherein the serrated edge for each one of the sides further comprises a plurality of teeth with a first length and at least one tooth having a second length with a second length greater than the first length.

8. The dispenser of claim 1, wherein the first section of the backplate, the spindle, and the sidewall together form a channel with an open space between the sidewall and the backplate above the topside of the spindle.

9. A dispenser for a roll of adhesive tape, comprising:

a backplate extending from a first section to a second section in a first plane;

a spindle connected to the first section of the backplate at a proximal end and extending substantially perpendicular to the first plane to a distal end, wherein the roll of adhesive tape engages a topside of the spindle and rotates on the spindle relative to the backplate around an axis of rotation perpendicular to the first plane;

a sidewall connected to at least one of the distal end of the spindle and the backplate, wherein the sidewall extends substantially perpendicular to the spindle in a second plane substantially parallel to the first plane, and wherein the sidewall extends to an upper end within the second plane;

a cutting surface connected to the second section of the backplate and extending substantially perpendicular to the first plane, wherein the cutting surface extends to a distal edge, wherein the cutting surface comprises a pair of sides, wherein at least one of the sides comprises a serrated edge, and wherein the serrated edge is substantially parallel to the axis of rotation; and a writing device holder connected to at least one of the backplate, the sidewall, and the cutting surface, wherein the writing device holder is positioned along a centerline relative to a width of the spindle.

10. The dispenser of claim 9, wherein the spindle is selected from the group of support structures consisting of an arcuate surface, a beam, a plurality of posts, and any combination thereof, wherein the topside of the spindle is fixedly located relative to the backplate, and wherein the sidewall is fixedly attached to at least one of the distal end of the spindle and the backplate.

11. The dispenser of claim 9, wherein the writing device holder is selected from a group of holders consisting of a bar, a clip, an aperture, an elastic strap, a hook and loop fastener, and any combination thereof.

12. The dispenser of claim 9, wherein the writing device holder is attached to the sidewall and extends outwardly away from the spindle.

13. The dispenser of claim 9, wherein the first section of the backplate, the spindle, and the sidewall together form a channel with an open space between the sidewall and the backplate above the topside of the spindle, wherein the first section of the backplate is on an upper side of a lateral median line and the second section is on a lower side of the lateral median line, wherein the topside of the spindle faces away from the lateral median line, and wherein the writing device holder is positioned at an elevation line that is at or above the lateral median line.

14. The dispenser of claim 9, further comprising a tab comprising a base and a tip, wherein the base of the tab is connected to the backplate, and wherein the tab is arranged in a second plane substantially parallel to the first plane of the backplate with the tip extending upward from the base toward the sidewall.

15. A dispenser for a roll of adhesive tape, comprising:

a backplate extending from a first section to a second section in a first plane, wherein the first section is on an upper side of a lateral median line and the second section is on a lower side of the lateral median line;

a spindle connected to the first section of the backplate at a proximal end and extending substantially perpendicular to the first plane to a distal end, wherein a topside of the spindle faces away from the lateral median line, wherein the roll of adhesive tape engages the topside of the spindle and rotates on the spindle relative to the backplate around an axis of rotation perpendicular to the first plane;

a sidewall connected to at least one of the distal end of the spindle and the backplate, wherein the sidewall extends substantially perpendicular to the spindle in a second plane substantially parallel to the first plane, wherein the sidewall extends to an upper end within the second plane, and wherein the upper end of the sidewall is further from the lateral median line than the topside of the spindle, and wherein the first section of the backplate, the spindle, and the sidewall together form a channel;

a cutting surface connected to the backplate and extending substantially perpendicular to the first plane, wherein the cutting surface extends to a distal edge, wherein the cutting surface comprises a pair of sides, wherein at least one of the sides comprises a serrated edge, and wherein the serrated edge is substantially parallel to the axis of rotation; and a writing device holder attached to at least one of the backplate, the sidewall, and the cutting surface, wherein the writing device holder is positioned along a centerline relative to a width of the spindle.

16. The dispenser of claim 15, wherein the channel is arcuate with an arc length less than a semicircle and forms an open space between the sidewall and the backplate above the topside of the spindle, wherein the sidewall is fixedly attached to at least one of the distal end of the spindle and the backplate, and wherein the cutting surface is connected to the second section of the backplate.

17. The dispenser of claim 15, wherein the spindle is selected from the group of support structures consisting of an arcuate surface, a beam, a plurality of posts, and any combination thereof, and wherein the topside of the spindle is fixedly located relative to the backplate between the lateral median line and the upper end of the sidewall.

18. The dispenser of claim 15, wherein the writing device holder is selected from a group of holders consisting of a bar, a clip, an aperture, hook and loop fasteners, and any combination thereof, and wherein the writing device holder is positioned at an elevation line that is at or above the lateral median line.

19. The dispenser of claim 15, wherein the serrated edge further comprises a plurality of teeth with a first length and at least one tooth having a second length with a second length greater than the first length, and wherein the serrated edge is substantially parallel to the axis of rotation.

20. The dispenser of claim 15, further comprising a tab comprising a base and a tip, wherein the base of the tab is connected to the backplate, and wherein the tab is arranged in a second plane substantially parallel to the first plane with the tip extending upward from the base toward the sidewall.

* * * * *